US012305286B2

(12) United States Patent
Gilbert et al.

(10) Patent No.: US 12,305,286 B2
(45) Date of Patent: May 20, 2025

(54) METAL SHEET TREATMENT METHOD AND METAL SHEET TREATED WITH THIS METHOD

(71) Applicant: ArcelorMittal, Luxembourg (LU)

(72) Inventors: Frida Gilbert, Antony (FR); Lydia Rachiele, Rombas (FR); Delphine Thai, Bousse (FR); Christian Allely, Metz (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 17/768,009

(22) PCT Filed: Oct. 12, 2020

(86) PCT No.: PCT/IB2020/059548

§ 371 (c)(1),
(2) Date: Apr. 11, 2022

(87) PCT Pub. No.: WO2021/074765

PCT Pub. Date: Apr. 22, 2021

(65) Prior Publication Data

US 2024/0093375 A1 Mar. 21, 2024

(51) Int. Cl.
*C23C 2/26* (2006.01)
*C23C 22/53* (2006.01)
(Continued)

(52) U.S. Cl.
CPC ..... *C23C 2/26* (2013.01); *C23C 22/53* (2013.01); *C23C 22/82* (2013.01); *C23C 28/3225* (2013.01); *C23C 28/34* (2013.01)

(58) Field of Classification Search
None
See application file for complete search history.

(56) References Cited

U.S. PATENT DOCUMENTS 6,528,182 B1 3/2003 Bello et al.
2011/0094630 A1* 4/2011 Yoshida ..... C25D 13/20 148/247

(Continued)

FOREIGN PATENT DOCUMENTS

JP 2002047578 A * 2/2002
JP 2006265578 A 10/2006

(Continued)

OTHER PUBLICATIONS

Search Report of PCT/IB2020/0059548 dated Jan. 11, 2021.
Written Opinion of PCT/IB2020/059548.

*Primary Examiner* — Xiaobei Wang
(74) *Attorney, Agent, or Firm* — Davidson Kappel LLC

(57) ABSTRACT

The invention relates to a steel substrate coated on at least one of its faces with a metallic coating based on zinc or its alloys wherein the metallic coating is itself coated with a conversion layer comprising:
zincsulphate hydrate,
aluminium in an amount up to 14 $mg \cdot m^{-2}$,
wherein the conversion layer comprises neither zinc hydroxysulphate, nor free water molecules nor any compounds having free hydroxyl groups, the surface density of sulphur in the conversion layer being greater than or equal to 5.0 $mg/m^2$. The invention also relates to the corresponding treatment method.

16 Claims, 1 Drawing Sheet

(51) Int. Cl.
*C23C 22/82* (2006.01)
*C23C 28/00* (2006.01)

(56) References Cited

U.S. PATENT DOCUMENTS

| | | | | |
|---|---|---|---|---|
| 2015/0093594 | A1 | 4/2015 | Chaleix et al. | |
| 2017/0260471 | A1 | 9/2017 | Lostak et al. | |
| 2020/0216964 | A1* | 7/2020 | Rachiele | C23C 22/74 |
| 2020/0299844 | A1* | 9/2020 | Rachiele | C23C 28/3225 |

FOREIGN PATENT DOCUMENTS

| | | | |
|---|---|---|---|
| JP | 2009127077 | A | 6/2009 |
| JP | 2010090464 | A | 4/2010 |
| WO | WO 99/35307 | A1 | 7/1999 |
| WO | WO00/15878 | | 3/2000 |
| WO | WO2019/073273 | | 4/2019 |
| WO | WO2019/073274 | | 4/2019 |

* cited by examiner number of waves

METAL SHEET TREATMENT METHOD AND METAL SHEET TREATED WITH THIS METHOD

This invention relates to a metal sheet comprising a steel substrate that is coated on at least one of its faces with a metallic coating based on zinc or its alloys.

The invention concerns in particular the pre-lubrification of this coated steel substrate and its treatment in aqueous solutions containing sulphates.

BACKGROUND

Metal sheet of this type is intended in particular to be used for the fabrication of parts for automobiles, although it is not limited to those applications.

It is known from US2017/0260471 to treat a zinc-coated metal sheet with an aqueous solution comprising a sulphate from a group consisting of aluminium sulphate, ammonium sulphate, iron sulphate, and magnesium sulphate to obtain good tribological conditions in the forming of flat steel products system.

This patent application discloses that the tribologically active layers comprising the listed sulphates achieve the same effect as conventional coatings disclosed, for example, in WO00/15878.

It is indeed already known from WO00/15878 to treat a zinc-coated metal sheet with an aqueous solution comprising zinc sulphate to form a layer of zinc hydroxysulphate on the zinc-based coating. This conversion layer of zinc hydroxysulphate provides a pre-lubricated zinc-coated metal sheet with higher performances than those obtained by phosphating.

It has nevertheless been observed that this conversion layer based on zinc hydroxysulphate could offer insufficient adhesion to adhesives used in the automotive industry, notably epoxy-based adhesives.

The patent applications WO2019/073273 and WO2019/073274 disclose a steel substrate coated on at least one of its faces with a metallic coating based on zinc or its alloys wherein the metallic coating is itself coated with a conversion layer comprising at least one of the compounds selected from among zinc sulphate monohydrate, zinc sulphate tetrahydrate and zinc sulphate heptahydrate, wherein the conversion layer comprises neither zinc hydroxysulphate nor free water molecules nor free hydroxyl groups, the surface density of sulphur in the conversion layer being greater than or equal to 0.5 mg/m$^2$.

These patent applications also disclose the treatment method for producing this steel substrate comprising the steps according to which:

(i) a strip of steel coated on at least one of its faces with a metallic coating based on zinc or its alloys is provided, (ii) an aqueous treatment solution comprising at least 0.01 mol/L of zinc sulphate is applied to the metallic coating by simple contact so as to form a wet film, (iii) the aqueous treatment solution is subsequently dried in a dryer at a air specific drying temperature, the time between the application of the aqueous treatment solution on the metallic coating and the exit of the dryer being less than 4 seconds, wherein the strip velocity, the wet film thickness, the initial strip temperature and the air flow rate are adapted to form, on the metallic coating, a conversion layer comprising neither free water molecules nor free hydroxyl groups, the surface density of sulphur in the conversion layer being greater than or equal to 0.5 mg/m$^2$. In the patent application WO2019/073273, the air drying temperature is above 170° C. In the patent application WO2019/073274, the air drying temperature is below 80° C.

SUMMARY OF THE INVENTION

In both patent applications, although the conversion layer comprises neither zinc hydroxysulphate nor free water molecules nor free hydroxyl groups which degrade the adhesion to adhesives used in automotive industry, the treatment method includes an air drying performed at very specific temperatures. They are very restrictive since outside the drying temperature range, hydroxyzincsulphate structure is formed degrading the adhesion of adhesives used in the automotive industry, notably epoxy-based adhesives. All the plants cannot handle or be modified to obtain such drying temperatures. Finally, the process is complex since it requires that the time between the application of the aqueous treatment solution on the metallic coating and the exit of the dryer is less than 4 seconds.

It is an object of the present invention to remedy the drawbacks (of the facilities and processes) of the prior art by providing a surface treatment offering better adhesion to adhesives used in the automotive industry, notably epoxy-based adhesives whatever the drying temperature.

The present invention provides a steel substrate coated on at least one of its faces with a metallic coating based on zinc or its alloys wherein the metallic coating is itself coated with a conversion layer comprising:

zincsulphate hydrate, aluminium in an amount up to 14 mg·m$^{-2}$, wherein the conversion layer comprises neither zinc hydroxysulphate, nor free water molecules nor any compounds having free hydroxyl groups, the surface density of sulphur in the conversion layer being greater than or equal to 5.0 mg/m$^2$.

The steel substrate according to the invention may also have the optional features listed below, considered individually or in combination:

Aluminium is in an amount up to 13.0 mg·m$^2$, the aluminium of the conversion layer is in the form of aluminium sulphate and/or aluminium hydroxide, the aluminium amount in the conversion layer is comprised between 5.0 and 13.0 mg·m$^{-2}$, the zincsulphate hydrate comprises at least one of the compounds selected from among: zinc sulphate monohydrate ($ZnSO4 \cdot H_2O$), zinc sulphate tetrahydrate ($ZnSO_4 \cdot 4H_2O$) and zinc sulphate heptahydrate ($ZnSO_4 \cdot 7H_2O$), the surface density of sulphur in the conversion layer is between 5.0 and 22.0 mg/m$^2$, the metallic coating based on zinc or its alloys comprises at least one element among magnesium up to a content of 10% by weight, aluminium up to a content of 20% by weight, silicon up to a content of 0.3% by weight, the metallic coating based on zinc or its alloys comprises at least 0.1% by weight of magnesium, The present invention also provides an automotive part made of a steel substrate according to the invention.

The present invention also provides a treatment method for a moving metal strip comprising the steps according to which:

i. a strip of steel coated on at least one of its faces with a metallic coating based on zinc or its alloys is provided, ii. an aqueous treatment solution comprising at least 0.01 mol·L$^{-1}$ of zinc sulphate and at least 0.01 mol·L$^{-1}$ of aluminium sulphate is applied to the metallic coating by simple contact so as to form a wet film, iii. the aqueous treatment solution is subsequently dried with air to form, on the metallic coating, a conversion layer comprising:
zincsulphate hydrate,
aluminium in an amount up to 14 $mg \cdot m^{-2}$,
wherein the conversion layer comprises neither zinc hydroxysulphate, nor free water molecules nor any compounds having free hydroxyl groups, the surface density of sulphur in the conversion layer being greater than or equal to 5.0 $mg/m^2$.

The treatment method according to the invention may also have the optional features listed below, considered individually or in combination:

Aluminium is in an amount up to 13.0 $mg \cdot m^2$, the aqueous treatment solution contains between 10 and 140 g/L of zinc sulphate heptahydrate, the aqueous treatment solution contains between 1 and 80 g/L of aluminium sulphate octadecahydrate, the ratio in weight of zinc amount with respect to aluminium amount in the aqueous solution is from 5 to 40, the metallic coating can be deposited by hot-dip coating, electrocoating deposition or physical vapor deposition, the metallic coating is degreased before application of the aqueous treatment solution, the wet film thickness is between 0.5 and 4 μm, a film of oil with a coating weight of less than 2 $g/m^2$ is applied on the conversion layer, the drying temperature is between 20 and 200° C.

Without being bound to any scientific theory, it seems that the presence of zinc hydroxysulphate itself in the conversion layer led to the weak adhesion of the treated metal sheet on some adhesives, notably epoxy-based adhesives. Indeed, the hydroxyl groups of the zinc hydroxysulphate structure react with the epoxy system of the adhesive and lead to adhesion problems. In particular, their presence degrades the interfacial bonds zinc/epoxy and causes also the plasticization of the adhesive.

Moreover, the inventors have observed that free water molecules and/or free hydroxyl groups can be present in the conversion layer even when it is apparently dry. These free water molecules and/or free hydroxyl groups are also very reactive with specific compounds of the adhesive such as, for example, epoxy-based compounds which leads to adhesion problems.

The inventors have done intensive searches to obtain a layer excluding zinc hydroxysulphate and perfectly dried, i.e. without free water molecules and free hydroxyl groups, whatever the drying conditions so as to obtain a layer with good adhesion to epoxy adhesives while preserving the other properties.

From a product point of view, these researches have revealed that improved adhesion to epoxy adhesives whatever the drying conditions was possible if the conversion layer comprised zincsulphate hydrate and aluminium in an amount up 14.0 $mg \cdot m^{-2}$.

Indeed, it is believed that the structure of the conversion layer further comprising up to 14.0 $mg \cdot m^{-2}$ of Al further improves the adhesion to adhesives. It seems that aluminium catches the free hydroxy groups resulting from the oxidation of the metallic coating which prevents the pH from increasing up to 7, at which point zinc hydroxysulphate starts precipitating on the metallic coating. Moreover, as aluminium keeps the pH low enough to avoid the precipitation of zinc hydroxysulphate, there is no need anymore to carefully select the drying conditions so that only the stable zincsulphate hydrates are formed. In the present case, even if unstable hydrates are contained in the conversion layer, they will not decompose into zinc hydroxysulphate. Furthermore, as aluminium catches the free hydroxy groups, the formation of free water molecules is also prevented.

Thus, contrary to patents applications WO2019/073273 and WO2019/073274, no specific drying temperature is needed, and no specific time between the application of the aqueous treatment solution on the metallic coating and the exit of the dryer is needed. The treatment method of the present invention can be easily implemented in plants without handling huge changes. Moreover, the coated sheet of the present invention has a better adhesion to adhesives than the sheets of the prior art described in particular in US2017260471 and WO00/15878.

BRIEF DESCRIPTION OF THE DRAWINGS

The invention will be better understood by reading the following description, which is provided purely for purposes of explanation and is in no way intended to be restrictive with reference to FIGS. 1*a, b, c* which are IRRAS (InfraRed Reflection-Adsorption Spectroscopy) spectrums of the conversion layer according to the invention and to the prior art.

DETAILED DESCRIPTION

Figures 1A, 1B, 1C:
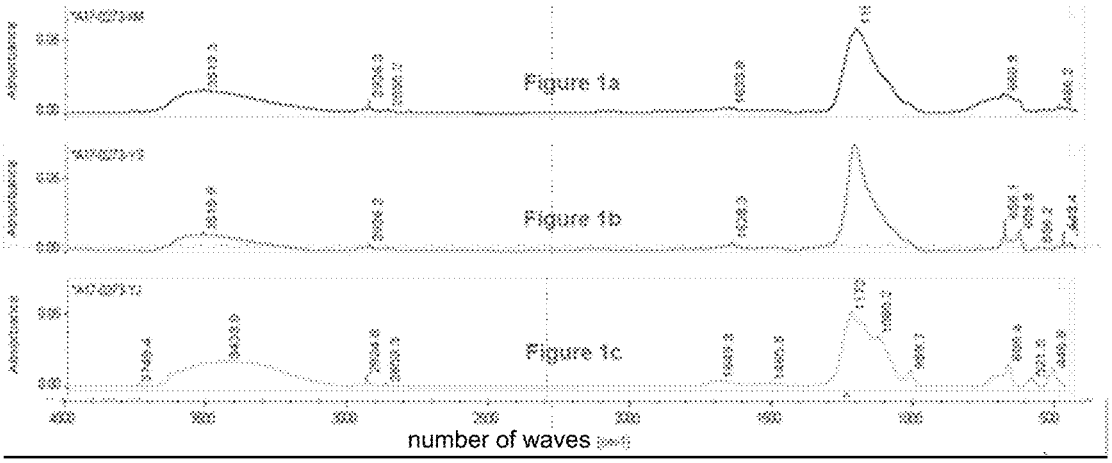

First of all, the invention relates to a steel substrate. It can be in the form of a metal strip. It is preferably hot-rolled and then cold-rolled. It can be coiled for later use as a part for an automobile body, for example.

The steel substrate is coated on at least one of its faces with a metallic coating based on zinc, i.e. unalloyed zinc, or its alloys, i.e. zinc comprising one or more alloying elements, such as for example but not being restricted thereto, iron, aluminium, silicon, magnesium and nickel. In certain variants, a coating of this type can be present on both faces of the substrate.

The metallic coating generally has a thickness of less than or equal to 20 μm and is intended for the purpose of protecting the substrate against perforating corrosion, in the conventional manner.

In one variant of the invention, the metallic coating comprises between 0.1% and 0.4% by weight aluminium, the rest being zinc and the unavoidable impurities resulting from the manufacturing process.

In one variant of the invention, the metallic coating comprises at least 0.1% by weight magnesium to improve the resistance to corrosion. Preferably, the metallic coating contains at least 0.5% and more preferably at least 2% by weight magnesium.

In another preferred embodiment, the metallic coating based on zinc or its alloys comprises at least one element among magnesium up to a content of 10% by weight, aluminium up to a content of 20% by weight, silicon up to a content of 0.3% by weight.

In another preferred embodiment, the metallic coating based on zinc or its alloys comprises 0.01-8.0 wt % Al, optionally 0.2-8.0 wt % Mg, the remainder being Zn and the unavoidable impurities resulting from the manufacturing process. For example, the zinc-based coating comprises 1.2 wt. % of Al and 1.2 wt. % of Mg or 3.7 wt. % of Al and 3 wt. % of Mg.

The metallic coating based on zinc or its alloys can be deposited by hot-dip coating. In this case, the bath can also contain up to 0.3% by weight of optional additional elements such as Sr, Sb, Pb, Ti, Ca, Mn, Sn, La, Ce, Cr, Ni, Zr or Bi.

These different elements can, among other things, improve the ductility or the adherence of the metallic coating to the substrate. A person skilled in the art who is familiar with their effects on the characteristics of the coating will know how to use them as a function of the additional purpose sought.

Finally, the bath can contain residual elements originating from the feeding ingots melted or resulting from the passage of the substrate through the bath, such as iron in a content up to 5% by weight, preferably 3% by weight. These residual elements are partly incorporated into the metallic coating, in which case they are designated by the term "unavoidable impurities resulting from the manufacturing process".

The metallic coating based on zinc or its alloys can be also be deposited by electro-coating deposition or physical vapor deposition. In this case, it is possible to deposit a metallic coating consisting of zinc, i.e. wherein the amount of zinc is above 99 wt %.

The metallic coating is at least partially covered by a conversion layer comprising zincsulphate hydrate and aluminium in an amount up to 14 $mg \cdot m^{-2}$.

Zincsulphate hydrate and aluminium work in synergy. The zincsulphate hydrate provides the performances as established by the prior art while the aluminium provides conditions in which the zincsulphate hydrate is stable so that the appearance of zinc hydroxysulphate and of free water molecules is prevented.

The zincsulphate hydrate is of general formula: $Zn_x(SO_4)_{y \cdot z}H_2O$ where x, y and z are different from zero. Advantageously, it comprises at least one of the compounds selected from among: zinc sulphate monohydrate ($ZnSO_4 \cdot H_2O$), zinc sulphate tetrahydrate ($ZnSO_4 \cdot 4H_2O$) and zinc sulphate heptahydrate ($ZnSO_4 \cdot 7H_2O$). These are stable compounds. Thanks to their presence, a later development of zinc hydroxysulphate by decomposition of unstable zincsulphate hydrates is avoided.

The amount of aluminium is limited to 14 $mg \cdot m^{-2}$, preferably 13.0 $mg \cdot m^{-2}$, as it is believed that a higher amount of aluminium might decrease the adhesion bonding.

Preferably, the aluminium amount in the conversion layer is from 5 to 14 $mg \cdot m^{-2}$ and more preferably from 7 to 13 $mg \cdot m^{-2}$.

The form in which Aluminium is present in the conversion layer of the invention is not particularly limited. Without willing to be bound by any theory, it is believed that Aluminium is mainly present in the form of Aluminium sulphate and/or Aluminium hydroxide ($Al(OH)_3$), resulting from the combination of Aluminium with the free hydroxy groups. Preferably, the conversion layer thus comprises zincsulphate hydrate and at least one of aluminium sulphate and aluminium hydroxide.

The conversion layer also comprises neither zinc hydroxysulphate, nor free water molecules nor any compounds having free hydroxyl groups.

Zinc hydroxysulphate contains hydroxyl groups that, based on inventors' understanding, react with the epoxy system of the adhesive and lead to adhesion problems. Its absence significantly improves the adhesion of epoxy-based adhesives on metal sheets. By zinc hydroxysulphate, it is meant the compound of general formula:

$$[Zn_x(SO_4)_y(OH)_z, tH_2O]$$

where 2x=2y+z, with y and z different from zero.

z is often higher than or equal to 6, and more often z=6 and $3 \leq t \leq 5$. In particular, compound with x=4, y=1, z=6 and t=3 has been observed on metal sheets from the prior art.

Free water molecules and free hydroxyl groups are also very reactive with specific compounds of the adhesive such as, for example, epoxy-based compounds which leads to adhesion problems. Their absence significantly improves the adhesion of epoxy-based adhesives on metal sheets.

The presence of sulphate in the conversion coating is assessed and quantified by the measure of the surface density of Sulphur. In this case, the surface density of sulphur in the conversion layer is greater than or equal to 0.5 $mg/m^2$. Below this value, it seems that the metallic coating deteriorates while the metal sheet is formed, which results in the formation of powder or particles of zinc or its alloys at the surface of the metal sheet. The accumulation and/or agglomeration of these particles or this powder in the forming tools may damage the formed parts, by the formation of barbs and/or constrictions.

Preferably, the surface density of sulphur in the conversion layer is between 5.0 and 22.0 $mg/m^2$, more preferably between 10.0 and 22.0 $mg/m^2$ and advantageously between 13.0 and 22.0 $mg/m^2$. Without willing to be bound by any theory, it is believed that these amounts of Sulphur further improve the adhesive bonding of the steel substrate according to the present invention.

The surface density of sulphur in the conversion layer can be measured by ICP or X Ray Fluorescence (XRF).

From a process point of view, the conversion layer can be obtained by the application to the coating, possibly after degreasing, of an aqueous treatment solution comprising at least 0.01 $mol \cdot L^{-1}$ of zinc sulphate and at least 0.01 $mol \cdot L^{-1}$ of aluminium sulphate.

It is not possible to form such a layer when the concentration of zinc sulphate is less than 0.01 $mol \cdot L^{-1}$, but it has also been found that a too high concentration does not significantly improve the rate of deposition and may even slightly reduce it. Preferably, the aqueous treatment solution contains zinc sulphate $ZnSO_4$ in a concentration below or equal to 50 $mol \cdot L^{-1}$ and aluminium sulphate $Al_2(SO_4)_3$ in a concentration below or equal to 50 $mol \cdot L^{-1}$.

The aqueous treatment solution can be prepared by dissolving zinc sulphate and aluminium sulphate in pure water. For example, zinc sulphate heptahydrate ($ZnSO_4 \cdot 7H_2O$) can be used. For example, aluminium sulphate octadecahydrate ($Al_2(SO_4)_3 \cdot 18H_2O$) can be used. In one variant of the invention, the aqueous treatment solution consists in zinc sulphate, aluminium sulphate and water.

Preferably, the aqueous treatment solution contains between 10 and 140 $g \cdot L^{-1}$ of zinc sulphate heptahydrate, more preferably between 10 and 80 $g \cdot L^{-1}$ and advantageously between 10 and 40 $g \cdot L^{-1}$.

Preferably, the aqueous treatment solution contains between 1 and 80 $g \cdot L^{-1}$ of aluminium sulphate octadecahydrate, more preferably between 10 and 60 $g \cdot L^{-1}$ and advantageously between 10 and 30 $g \cdot L^{-1}$.

Advantageously, the ratio in weight of zinc amount with respect to aluminium amount in the aqueous solution is comprised between 5 and 40, more preferably between 5 and 30 and advantageously between 10 and 25. Indeed, without willing to be bound by any theory, it is believed that when the ratio in weight of zinc amount with respect to aluminium amount in the aqueous solution is as above, there is a further improvement of adhesive bonding.

The pH of the aqueous treatment solution preferably corresponds to the natural pH of the solution, without the addition of either base or acid. The value of this pH is generally between 4 and 7.

The temperature of the aqueous treatment solution can be between 20 and 60° C.

The aqueous treatment solution can be applied to the metallic coating by simple contact and dried at air whatever the drying temperature. It is applied in the conventional manner, e.g., by dipping, roll-coating, spraying eventually followed by squeezing.

Preferably, the wet film thickness is between 0.5 and 4 μm.

Preferably, the aqueous treatment solution is subsequently dried in a dryer at air. Preferably the dryer comprises between 6 and 12 nozzles to better distribute the air jet impingement on the metal strip. Preferably the dryer comprises nozzles positioned between 4 and 12 cm from the metal strip to avoid pressure loss in the jet without removing the wet film from the metal strip. Preferably the nozzles have openings which width is comprised between 2 mm and 8 mm so as to optimize the air velocity at the nozzle exit.

Preferably, the drying temperature is between 20 and 200° C., more preferably between 50 and 200° C. and for example below 80° C., between 80 and 150° C. or above 150° C.

Preferably, the strip velocity is between 60 and 200 m/min.

Preferably, the initial strip temperature is between 20 and 50° C.

Preferably, the air flow rate is between 5000 and 50000 $Nm^3/h$.

After the formation of the conversion layer, a film of oil with a coating weight of less than 2 $g/m^2$ can be applied on the conversion layer.

From a practical point of view, the absence of zinc hydroxysulphate can be controlled by infrared spectroscopy in IRRAS mode (Infrared Reflection-Adsorption spectroscopy with an incidence angle of 80°). If the conversion layer comprises zinc hydroxysulphate, the IRRAS spectrum presents multiple absorption peaks assigned to the $\nu_3$ sulphate vibrations 1077-1136-1177 $cm^{-1}$ and active water bands in the OH stretching region 3000-3400 $cm^{-1}$. These results match the hydroxyzincsulphate structure as indicated in the literature ($\nu_1$ sulphate vibration: 1000 $cm^{-1}$, $\nu_2$ sulphate vibration: 450 $cm^{-1}$, $\nu_3$ sulphate vibrations: 1068-1085-1130 $cm^{-1}$, $\nu_4$ sulphate vibrations: 611-645 $cm^{-1}$, hydroxyl vibration: 3421 $cm^{-1}$).

The presence of the zincsulphate hydrate can be controlled by infrared spectroscopy in IRRAS mode. If the conversion layer comprises zincsulphate hydrate without zinc hydroxysulphate, the IRRAS spectrum presents one single sulphate peak located around 1172 $cm^{-1}$ instead of 3 peaks. More specifically, the presence of each of the stable zincsulphate hydrates mentioned above can be controlled by infrared spectroscopy in IRRAS mode coupled to Differential Scanning calorimetry (DSC) by tracking the sulphate bands and free water bands.

The wet film thickness can be measured with an infrared gauge positioned before the dryer. It is composed of a light source, an infrared detector and specific filters. The measurement principle is based on infrared light absorption.

At the exit of the dryer, the absence of water in the conversion layer can be controlled notably with a hyperspectral camera. This latter is made of an infrared matrix detector coupled to a spectrometer which disperses the light into wavelengths. The measurement apparatus may be composed of a linear shape IR lamp (800 mm length) and a MWIR (Mid-Wave IR) hyperspectral camera in bidirectional reflection configuration. The detection range of the camera is 3-5 μm which corresponds to the main absorption bands of liquid water. The measurement principle consists in measuring the intensity of light reflected off the metal strip. If water remains in the conversion layer, it absorbs a part of the light and less intensity is reflected.

In a variant, the absence of water in the conversion layer at the exit of the dryer is controlled by monitoring the temperature of the steel strip in the dryer. As long as there is water in the film, the thermal energy of hot air is spent for evaporating water and the temperature of the metal strip remains constant or even decreases due to water evaporation. Once the film is dry, the thermal energy of hot air is spent for heating the metal strip. By monitoring the temperature of the steel strip in the dryer, it is thus easy to control that the temperature of the metal strip starts to increase before the exit of the dryer.

With a view to highlighting the enhanced performance obtained by using the treatment method and steel substrate according to the invention, some concrete examples of embodiments will be detailed in comparison with coated steel sheets based on the prior art.

Example 1

As will be seen in the following non-restricting examples, which are presented exclusively by way of illustration, the inventors have shown that the invention makes it possible to improve the adhesion to adhesives used in the automotive industry, notably epoxy-based adhesives without degrading the other performances.

10 trials were prepared by applying an aqueous treatment solution on a galvanized steel sheet or on an electrogalvanized steel sheet by roll-coating and by drying the wet film with different drying conditions.

Trials 1 and 2 were prepared according to the patent application US2017/0260471 by applying an aqueous solution comprising aluminium sulphate octadécahydrate $Al_2(SO_4)_3 \cdot 18H_2O$ on a galvanized steel sheet (GI). The concentration of aluminium sulphate octadécahydrate $Al_2(SO_4)_3 \cdot 18H_2O$ was of 22 $g \cdot L^{-1}$ which corresponds to a concentration of $Al_2(SO_4)_3$ of 0,033 $mol \cdot L^{-1}$. Trial 1 was subsequently dried in a dryer with air having a temperature of 100° C. for 5 seconds. Trial 2 was subsequently dried at air in a dryer having a temperature of 180° C. for 8 minutes.

Trials 3 and 4 were prepared according to the patent application WO00/15878 by applying an aqueous solution comprising zinc sulphate heptahydrate $ZnSO_4 \cdot 7H_2O$ on a galvanized steel sheet. Trial 3 was subsequently dried in a dryer with air having a temperature of 100° C. during less than 4 seconds. Trial 4 was subsequently dried in a dryer with air having a temperature of 180° C. during 8 minutes.

For Trial 3, the strip velocity was of 120 m/min. The initial strip temperature was of 35° C.

Trial 5 was prepared according to the patent application WO2019/073273 by applying an aqueous solution comprising zinc sulphate heptahydrate $ZnSO_4 \cdot 7H_2O$ on a galvanized steel sheet. The concentration of zinc sulphate heptahydrate was of 120 $g \cdot L^{-1}$ which corresponds to a concentration of $Zn^{2+}$ ions and a concentration of $SO_4^{2-}$ of 0.42 $mol \cdot L^{-1}$. The wet film had a thickness of 1.5 μm. The wet film was subsequently dried within 4 seconds at air in a dryer having a temperature of 175° C. The strip velocity was of 120 m/min. The initial strip temperature was of 35° C.

Trial 6 was prepared according to the patent application WO2019/073274 by applying an aqueous solution comprising zincsulphate heptahydrate $ZnSO_4 \cdot 7H_2O$ on a galvanized steel sheet. The concentration of zincsulphate heptahydrate was of 120 $g \cdot L^{-1}$ which corresponds to a concentration of $Zn^{2+}$ ions and a concentration of $SO_4^{2-}$ of 0.42 $mol \cdot L^{-1}$. The wet film had a thickness of 1.5 μm. The wet film was subsequently dried within 4 seconds in a dryer at air having a temperature of 75° C. The strip velocity was of 120 m/min. The initial strip temperature was of 35° C.

Trials 7 and 8 were prepared by applying an aqueous solution comprising zincsulphate heptahydrate $ZnSO_4 \cdot 7H_2O$ and aluminiumsulphate octadécahydrate $Al_2(SO_4)_3 \cdot 18H_2O$ on a galvanized steel sheet. The concentration of aluminiumsulphate octadécahydrate $Al_2(SO_4)_3 \cdot 18H_2O$ was of 25 $g \cdot L^{-1}$ which corresponds to a concentration of $Al^{3+}$ ions of 0,075 $mol \cdot L^{-1}$ and 2.02 $g \cdot L^{-1}$ and a concentration of $SO_4^{2-}$ of 0.113 $mol \cdot L^{-1}$. The concentration of zincsulphate heptahydrate was of 120 $g \cdot L^{-1}$ which corresponds to a concentration of $Zn^{2+}$ ions of 0.42 $mol \cdot L^{-1}$ and 27.28 $g \cdot L^{-1}$ and a concentration of $SO_4^{2-}$ of 0.42 $mol \cdot L^{-1}$. The ratio in weight of the zinc amount with respect to the aluminium amount in the aqueous solution is thus of 13.5. The wet films had a thickness of 1 to 1.5 μm. Trial 7 was subsequently dried at air in a dryer having a temperature of 75° C. during less than 4 seconds. Trial 8 was subsequently dried at air in a dryer having a temperature of 100° C. for less than 4 seconds.

Trial 9 was prepared by applying an aqueous solution comprising zincsulphate heptahydrate $ZnSO_4 \cdot 7H_2O$ and aluminiumsulphate octadécahydrate $Al_2(SO_4)_3 \cdot 18H_2O$ on a galvanized steel sheet. The concentration of aluminiumsulphate octadécahydrate $Al_2(SO_4)_3 \cdot 18H_2O$ was of 4.2 $g \cdot L^{-1}$ which corresponds to a concentration of $Al^{3+}$ of 0.013 $mol \cdot L^{-1}$ and 0.35 $g \cdot L^{-1}$ and a concentration of $SO_4^{2-}$ of 0.019 $mol \cdot L^{-1}$. The concentration of zincsulphate heptahydrate was of 32 $g \cdot L^{-1}$ which corresponds to a concentration of $Zn^{2+}$ ions of 0.111 $mol \cdot L^{-1}$ and 7.27 $g \cdot L^{-1}$ and a concentration of $SO_4^{2-}$ of 0.111 $mol \cdot L^{-1}$. The ratio in weight of the zinc amount with respect to the aluminium amount in the aqueous solution is thus of 20.77. Trial 9 was subsequently dried at air in a dryer having a temperature of 180° C. for 8 minutes.

Trial 10 was prepared by applying an aqueous solution comprising zincsulphate heptahydrate $ZnSO_4 \cdot 7H_2O$ and aluminiumsulphate octadécahydrate $Al_2(SO_4)_3 \cdot 18H_2O$ on an electrogalvanized steel sheet (EG). The concentration of aluminiumsulphate octadécahydrate $Al_2(SO_4)_3 \cdot 18H_2O$ was of 4.2 $g \cdot L^{-1}$ which corresponds to a concentration of $Al^{3+}$ of 0.013 $mol \cdot L^{-1}$ and 0.35 $g \cdot L^{-1}$ and a concentration of $SO_4^{2-}$ of 0.019 $mol \cdot L^{-1}$. The concentration of zincsulphate heptahydrate was of 32 $g \cdot L^{-1}$ which corresponds to a concentration of $Zn^{2+}$ ions of 0.111 $mol \cdot L^{-1}$ and 7.27 $g \cdot L^{-1}$ and a concentration of $SO_4^{2-}$ of 0.111 $mol \cdot L^{-1}$. The ratio in weight of the zinc amount with respect to the aluminium amount in the aqueous solution is thus of 20.77. The wet film was subsequently dried at air in a dryer having a temperature of 180° C. for 8 minutes.

Surface Characterization

After drying, the surface of the conversion layer was characterized by IRRAS. The amount of sulphur in the layer was determined by ICP-MS.

Adhesion Test

The adhesion of epoxy-based adhesives on the conversion layer formed in all trials was evaluated by a single lap shear test. At first, test pieces 100 mm long and 25 mm wide were re-oiled using Anticorit Fuchs 3802-39S (1 $g/m^2$) without being degreased. Two test pieces, one treated with the aqueous treatment solution and one untreated, were then assembled with the epoxy-based adhesive Teroson® 8028 GB from Henkel® by overlapping them on 12.5 mm long using teflon shims in order to maintain a homogeneous thickness of 0.2 mm between the two pieces. The whole assembly was cured in the oven for 20 minutes at 190° C. The samples were then conditioned for 24 h before adhesion test and ageing test. For each test condition, 5 assemblies were tested.

The adhesion has been assessed according to DIN EN 1465 standard. In this test, each bonded assembly is fixed in the clamping jaws (gripping 50 mm of each test piece in each clamp and leaving 50 mm of each test piece free) of a tensile machine using cell force of 50 KN. The samples are pulled at a rate of 10 mm/min, at room temperature. The maximal shear stress values are recorded in MPa and the failure pattern is visually classified as:

- superficial cohesive failure if the tear appears in the bulk of the adhesive close to the strip/adhesive interface,
- adhesive failure if the tear appears at the strip/adhesive interface.

The test is not passed if the percentage of adhesive failure is high.

The ageing of the adhesion has been assessed by cataplasm test. In this test, each bonded assembly (5 specimens each time) is wrapped in cotton (weight of 45 g+/−5) with deionized water (10 times the weight of cotton), put in polyethylene bag which is then sealed. The sealed bag is kept in the oven at 70° C., 100% HR for 7 days. Once the cataplasm test has been performed, the adhesion is reassessed according to DIN EN 1465 standard.

Loss Factor Evaluation

Before and after the adhesion ageing, the tensile strength is measured for each trial using a tensile sensor. The mechanical loss factor, corresponding to the loss of tensile strength after the adhesion ageing, defined in percent was then determined. It is calculated using this formula:

$$\text{Loss factor (\%)} = \frac{\text{tensile strength before adhesion ageing} - \text{tensile strength after adhesion ageing}}{\text{tensile strength before adhesion ageing}} \times 100$$

Friction Test

Test pieces of trials 1, 3 and 7 were placed and clamped in a friction tool comprising two flats tools made of Tungsten Carbide reproducing a stamping tool. The end of the test pieces were then pulled using a pulling clamp. The pulling force of the pulling clamp, called Fp, varies from 10 to 80 MPa. The resulting normal force, called Fn, which is perpendicular to the direction of Fp increases during the pulling. The higher the tensile force Fp, the higher the contact pressure in the friction tool. Fp and Fn were measured during the test. Then, the friction coefficient, called μ, was calculated with the following formula:

$$\mu = \frac{Fp}{2 * Fn}$$

for 3 pulling forces (10, 40 and 80 MPa). The friction coefficient is expected to be between 0.07 and 0.15.

Results are in the following Table 1.

TABLE 1

| | Treatment method | | | Coated steel sheets obtained | | | | |
|---|---|---|---|---|---|---|---|---|
| | | | | Surface characterization of the zincsulphate based layer | | | Adhesion Test 0 day | |
| | | | | | ICP | | Adhesive | Cohesive |
| Trials | Coating | Aqueous solution | Drying conditions | IRRAS | S amount (mg · mg−2) | Al amount (mg · mg−2) | Failure (%) | Failure (%) |
| 1 (US2017260471) | GI | Al2(SO4)3•18H2O | 100° C., 5 s | — | 17 | 14 | 5 | 95 |
| 2 (US2017260471) | GI | Al2(SO4)3•18H2O | 180° C., 8 min | FIG. 1 a: 1 single sulphate peak: 1180 $cm^{-1}$ | 15 | 13 | 5 | 95 |
| 3 (WO00/15878) | GI | ZnSO4•7H2O | 100° C., <4 s | — | 18 | 0 | 5 | 95 |
| 4 (WO00/15878) | GI | ZnSO4•7H2O | 180° C., 8 min | FIG. 1c: 3 sulphate peaks: 1080-1130-1172 $cm^{-1}$ 1 hydroxyl peak: 3600 $cm^{-1}$ 1 water peak: 1650 $cm^{-1}$ | 15 | 0 | 25 | 75 |
| 5 (WO2019/073273) | GI | ZnSO4•7H2O | 175° C., <4s | — | 17 | 0 | 0 | 100 |
| 6 (WO2019/073274) | GI | ZnSO4•7H2O | 75° C., < 4s | — | 17 | 0 | 0 | 100 |
| 7* | GI | ZnSO4•7H2O and Al2(SO4)3•18H2O | 75° C., < 4 s | — | 16 | 12 | 0 | 100 |
| 8* | GI | ZnSO4•7H2O and Al2(SO4)3•18H2O | 100° C., <4 s | — | 16 | 12 | 0 | 100 |
| 9* | GI | ZnSO4•7H2O and Al2(SO4)3•18H2O | 180° C., 8 min | FIG. 1b: 1 single sulphate peak: 1170 $cm^{-1}$ | 15 | 13 | 0 | 100 |
| 10* | EG | ZnSO4•7H2O and Al2(SO4)3•18H2O | 180° C., 8 min | — | 18 | 7 | — | |

| | Coated steel sheets obtained | | | | | |
|---|---|---|---|---|---|---|
| | Adhesion Test 16 days | | Loss | | | |
| | Adhesive | Cohesive | factor | Friction behavior | | |
| Trials | Failure (%) | Failure (%) | (%) | 10 MPa | 40 MPa | 80 MPa |
| 1 (US2017260471) | 80 | 20 | 46 | 0.11 | 0.09 | 0.07 |
| 2 (US2017260471) | 80 | 20 | 56 | — | — | — |
| 3 (WO00/15878) | 70 | 30 | 37 | 0.11 | 0.11 | 0.07 |
| 4 (WO00/15878) | 100 | 0 | 65 | — | — | — |
| 5 (WO2019/073273) | 40 | 60 | — | — | — | — |
| 6 (WO2019/073274) | 50 | 50 | — | — | — | — |
| 7* | 50 | 50 | 29 | 0.11 | 0.11 | 0.08 |
| 8* | 50 | 50 | 31 | — | — | — |
| 9* | 30 | 70 | — | — | — | — |
| 10* | — | | | — | — | — |

*according to the present invention

As illustrated in the IRRAS spectrums of FIG. 1*a*, Trial 2 presents a single sulphate peak around 1180 $cm^{-1}$ assigned to the presence of aluminium sulphate. As illustrated in FIG. 1*c*, Trial 4 presents multiple absorption peaks assigned to the $\nu_3$ sulphate vibrations of the hydroxyzincsulphate structure. Moreover, Trial 4 comprises free water corresponding to the peaks located around 1650 $cm^{-1}$ and free hydroxyl groups corresponding to the peaks located with a peak located at 3600 $cm^{-1}$. As illustrated in FIG. 1*b*, Trial 9 according to the invention presents a single sulphate peak around 1170 $cm^{-1}$ assigned to zincsulphate hydrates. Hydroxyzincsulphate structure, free water and free hydroxyl groups were not detected in FIG. 1*b*.

As shown by the ICP-MS analysis, the amount of Sulphur of all Trials is above 0.5 $mg \cdot m^{-2}$. Trials 7 to 10 have an amount of aluminium above 0 and below or equal to 13 $mg \cdot m^{-2}$ according to the present invention.

The adhesive bonding of Trials 7 to 10 is significantly improved compared to Trials 1 to 4. Trials 7 to 10 have similar behavior adhesion to adhesives than Trials 5 and 6. Nevertheless, the treatment methods of Trials 5 and 6 are difficult to manage and implement compared to the treatment method of Trials 7 to 10.

The loss factor of Trials 7 and 8 is significantly better than Trials 1 to 4.

The friction behavior of Trials 1, 3 and 7 is similar.

Thus, the coated steel substrate of the present invention allows for an improvement of the adhesive bonding compared to the prior art without degrading the other performances and an easy-to-implement and easy-to-manage treatment method.

What is claimed is:

1. A coated steel comprising:

a steel substrate; and a metallic coating, the steel substrate coated on at least one face with the metallic coating, the metallic coating based on zinc or a zinc alloy wherein the metallic coating is itself coated with a conversion layer comprising:

zincsulphate hydrate, aluminium, wherein aluminum is present in an amount of no more than 14 $mg \cdot m^{-2}$, wherein the conversion layer comprises neither zinc hydroxysulphate, nor free water molecules nor any compounds having free hydroxyl groups, a surface density of sulphur in the conversion layer being greater than or equal to 5.0 $mg/m^2$.

2. The coated steel as recited in claim 1 wherein the aluminium of the conversion layer is in the form of aluminium sulphate or aluminium hydroxide.

3. The coated steel as recited in claim 1 wherein the aluminium amount in the conversion layer is comprised between 5.0 and 13.0 $mg \cdot m^{-2}$.

4. The coated steel as recited in claim 1 wherein the zincsulphate hydrate comprises at least one of the compounds selected from the group consisting of: zinc sulphate monohydrate ($ZnSO_4 \cdot H_2O$), zinc sulphate tetrahydrate ($ZnSO_4 \cdot 4H_2O$) and zinc sulphate heptahydrate ($ZnSO_4 \cdot 7H_2O$).

5. The coated steel as recited in claim 1 wherein the surface density of sulphur in the conversion layer is between 5.0 and 22.0 $mg/m^2$.

6. An automotive part made of the coated steel as recited in claim 1.

7. A treatment method for a moving metal strip comprising the following steps:

i. coating a strip of steel on at least one face with a metallic coating based on zinc or a zinc alloy;

ii. applying an aqueous treatment solution comprising at least 0.01 $mol \cdot L^{-1}$ of zinc sulphate and at least 0.01 $mol \cdot L^{-1}$ of aluminium sulphate to the metallic coating by simple contact so as to form a wet film, iii. subsequently drying the aqueous treatment solution with air to form, on the metallic coating, a conversion layer comprising:

zincsulphate hydrate, aluminium, wherein aluminum is present in an amount of no more than 14 $mg \cdot m^{-2}$, wherein the conversion layer comprises neither zinc hydroxysulphate, nor free water molecules nor any compounds having free hydroxyl groups, the surface density of sulphur in the conversion layer being greater than or equal to 5.0 $mg/m^2$.

8. The treatment method as recited in claim 7 wherein the aqueous treatment solution contains between 10 and 140 g/L of zinc sulphate heptahydrate.

9. The treatment method as recited in claim 7 wherein the aqueous treatment solution contains between 1 and 80 g/L of aluminium sulphate octadecahydrate.

10. The treatment method as recited in claim 7 wherein the ratio in weight of zinc amount with respect to aluminium amount in the aqueous solution is from 5 to 40.

11. The treatment method as recited in claim 7 wherein the metallic coating is deposited by hot-dip coating, electrocoating deposition or physical vapor deposition.

12. The treatment method as recited in claim 7 further comprising degreasing the metallic coating before application of the aqueous treatment solution.

13. The treatment method as recited in claim 7 wherein a thickness of the wet film is between 0.5 and 4 μm.

14. The treatment method as recited in claim 7 further comprising applying a film of oil with a coating weight of less than 2 $g/m^2$ on the conversion layer.

15. The treatment method as recited in claim 7 wherein the drying temperature is between 20 and 200° C.

16. The coated steel of claim 1, wherein the conversion layer consists of zincsulphate hydrate and at least one of aluminum sulphate and aluminum hydroxide, wherein aluminum is present in an amount of no more than 14 $mg \cdot m^{-2}$.

* * * * *